United States Patent [19]

Kwee

[11] 4,257,723

[45] Mar. 24, 1981

[54] DEVICE FOR SUCKING UP SOLID MATERIALS OR OBJECTS

[75] Inventor: Kiem T. Kwee, Amstelveen, Netherlands

[73] Assignee: IHC Holland N.V., Rotterdam, Netherlands

[21] Appl. No.: 69,102

[22] Filed: Aug. 21, 1979

[30] Foreign Application Priority Data

Aug. 23, 1978 [NL] Netherlands ..... 7808700

[51] Int. Cl.[3] ..... E02F 3/88

[52] U.S. Cl. ..... 406/49; 37/58; 37/DIG. 8

[58] Field of Search ..... 406/49, 108, 197, 198; 37/58, 195, DIG. 8; 299/8; 417/54, 108; 114/50

[56] References Cited

U.S. PATENT DOCUMENTS

| | | | |
|---|---|---|---|
| 2,857,873 | 10/1958 | Norelli et al. | 114/50 |
| 3,815,267 | 6/1974 | Laarman | 37/DIG. 8 X |
| 3,971,593 | 7/1976 | Porte et al. | 37/DIG. 8 X |
| 4,030,216 | 6/1977 | Willums | 37/DIG. 8 X |
| 4,053,181 | 10/1977 | Saito | 37/DIG. 8 X |

FOREIGN PATENT DOCUMENTS

| | | |
|---|---|---|
| 154389 | 3/1903 | Fed. Rep. of Germany . |
| 7004529 | 10/1970 | Netherlands . |
| 7107692 | 6/1972 | Netherlands . |
| 1505066 | 3/1978 | United Kingdom . |

*Primary Examiner*—James L. Rowland
*Attorney, Agent, or Firm*—Young & Thompson

[57] ABSTRACT

A device for sucking up solid objects, such as manganese modules, from the sea bed having a suction tube within which the density of the water is reduced by feeding in to said tube form-retaining light objects by means of a vertical supply conduit filled with air under high pressure through which the light objects fall down to enter the suction tube through a water slot, the said supply conduit being connected at its lower and upper end to an air filled return conduit to form a closed circuit, mechanism being provided to generate a downward flow of air in said supply conduit.

1 Claim, 2 Drawing Figures

DEVICE FOR SUCKING UP SOLID MATERIALS OR OBJECTS

The invention relates to a device for sucking up solid materials or objects with a density higher than water, said device comprising a suction tube running from the surface to be treated, such as the sea bed, to a position above the water level, said suction tube between its ends being connected to a closed tube the upper end of which is closed by means of a feeding device for light bodies keeping their shape, said tube being connected to a compressor by means of which the water can mainly be pressed out of the feeding tube with the exception of a water-trap at the position of the connection with the suction tube. Such a device is described in the older not pre-published Dutch patent application No. 78.03634.

The device according to this older proposal is particularly intended for sucking up objects such as manganese modules from a great depth. This means that in the feeding tubes for the form-retaining light objects by which a lower density of the water column in the suction tube is obtained, a high pressure will have to be maintained. In consequence of this tubes will have to be employed of a great length but also with a great wall thickness.

Because the rate of fall of the light objects in the compressed air, which has a high density, is small e.g. only 0.2 m/sec, in addition one needs tubes with a large diameter. This means that the feeding tubes will become exceptionally expensive.

The object of the invention is to improve this and according to the invention this object is achieved by providing this feeding tube with a return line above the water level of the water-trap, which return line is connected to the upper end of the feeding tube, said feeding tube and return line forming a closed circuit provided with a blower which can generate a downwardly directed stream of air in the feeding tube. By having the air streaming in a closed circuit the rate of fall of the light objects is increased by the air velocity and thus it is possible to make use of a feeding tube and a return line with a much smaller diameter, by which the required strength can be obtained by means of a smaller wall thickness.

Figure 2:
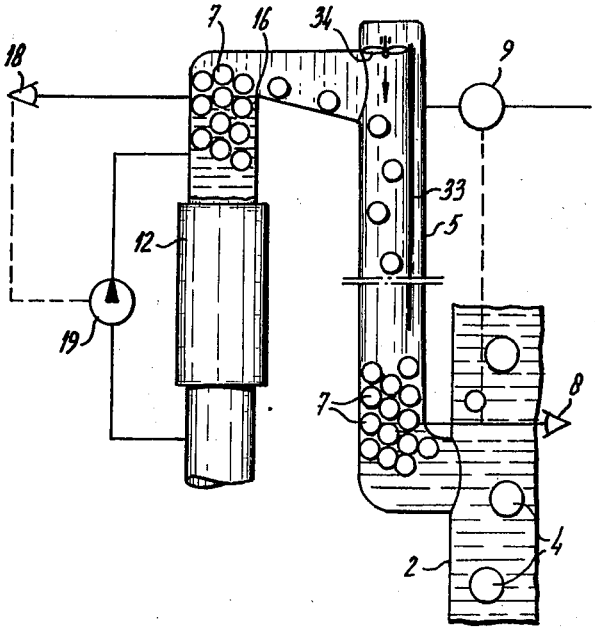

Now the invention will be described with reference to the drawing in which two embodiments are schematically shown, based on the design as shown in FIG. 2 of the Dutch patent application No. 78.03634.

Figure 1:
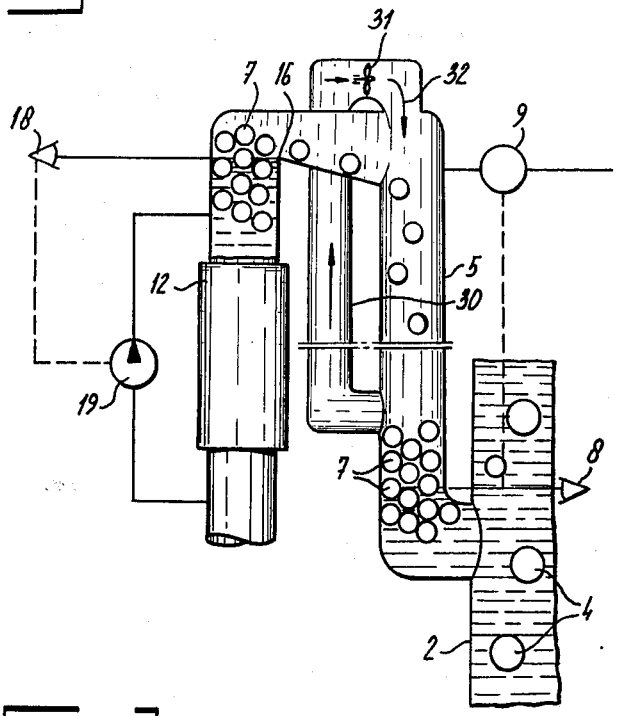

FIG. 1 shows a suction tube 2, in which the solid objects which have to be sucked up are indicated by 4 and the light objects by 7. A feeding tube 5 is connected to this tube 2 and is filled with pressurized air by means of a compressor 9, said compressor being controlled by means of a level indicator for the level 8, which maintains a water-trap in the tube 5 at its connection with the suction tube 2.

The light objects 7 falling down in the tube 5 pile up at the level of the water-trap and are pressed through this by their own weight and so will arrive in the suction tube 2.

The feeding tube 5 is closed at its upper end by a feeding lock 12 above which a water column is present the level of which is situated at an overflow edge 16, said level being controlled by means of a feeler 18 and being kept up to the mark by means of a pump 19. The light objects fed through the lock 12 pass the overflow edge 16 and fall down in the tube 5.

According to the invention a return line 30 is provided above the level of the water-trap 8 debouching into the upper end of the feeding tube 5 and being provided there with a blower 31 by means of which the air in the feeding tube 5 is moved in the direction of the arrow 32.

In the same way as FIG. 1 a modified form is shown in FIG. 2, the difference being that the return line is provided in the shape of a tube 33 situated within the tube 5. Instead of a tube it is also possible to use a baffle separating a part of the inner section of the tube 5 for the returning air. The blower is provided at 34.

The importance of the proposal according to the invention may appear from the following rough observation.

In case of a feeding tube with a length of 2250 meters the passing surface for a sufficient feeding of light objects is about 6 $m^2$. This means that six feeding tubes have to be used with a large diameter and with a wall thickness of about 20 cm. This results from the fact that the rate of fall of the light objects in the highly pressurized air is about 0.2 meter per second.

When the air velocity is increased by only 1 meter per second then the light objects will obtain a rate of fall of 1.2 meters per second and in consequence of this the needed total sectional surface for feeding the light objects is decreased from 6 $m^2$ to 0.9 $m^2$.

I claim:

1. A device for sucking up solid materials or objects with a density higher than water, said device comprising a suction tube running from the surface to be treated, such as the sea bed, to a position above the water level, said suction tube between its ends being connected to a closed tube the upper end of which is closed by means of a feeding device for light bodies keeping their shape, said tube being connected to a compressor by means of which the water can mainly be pressed out of the feeding tube with the exception of a water trap at the position of the connection with the suction tube, characterized in that said feeding tube is provided with a return line whose lower end is connected to the feeding tube at a point adjacent but above the water level of the water-trap, which return line is connected at its upper end to the upper end of the feeding tube, said feeding tube and return line forming a closed circuit provided with a blower which can generate a downwardly directed stream of air in the feeding tube.

* * * * *